US005935052A

United States Patent [19]

Hall et al.

[11] Patent Number: 5,935,052

[45] Date of Patent: Aug. 10, 1999

[54] ADAPTER FOR CENTRIFUGE TUBE

[75] Inventors: Richard Alan Hall, Kennett Square, Pa.; Edward Thomas Sheeran, Jr., Southbury; Michael Sean Sullivan, South Windsor, both of Conn.

[73] Assignee: Sorvall Products, L.P., Newtown, Conn.

[21] Appl. No.: 08/068,498

[22] Filed: May 27, 1993

[51] Int. Cl.[6] ..... B04B 5/02

[52] U.S. Cl. ..... 494/10; 494/16

[58] Field of Search ..... 422/99, 101; 436/45; 494/10, 16–18, 20, 21

[56] References Cited

U.S. PATENT DOCUMENTS

| | | | |
|---|---|---|---|
| 486,390 | 11/1892 | Berg | 494/10 |
| 780,315 | 1/1905 | Wetherill | 494/10 |
| 1,648,369 | 11/1927 | Svedberg | 494/10 |
| 2,617,585 | 11/1952 | Beyerle | 494/10 |
| 2,878,944 | 3/1959 | Anderson | 494/10 |
| 3,027,799 | 4/1962 | Weichselbaum | 88/14 |
| 3,361,343 | 1/1968 | Lerner | 494/16 |
| 3,674,197 | 7/1972 | Mitchell et al. | 233/14 R |
| 3,674,198 | 7/1972 | Eberle | 233/26 |
| 3,891,140 | 6/1975 | Ayres | 233/26 |
| 3,905,772 | 9/1975 | Hartnett et al. | 23/259 |
| 3,951,334 | 4/1976 | Fleming | 494/37 |
| 3,998,383 | 12/1976 | Romanauskas et al. | 233/26 |
| 4,015,775 | 4/1977 | Rohde | 233/26 |
| 4,141,489 | 2/1979 | Wright | 233/26 |
| 4,290,550 | 9/1981 | Chulay et al. | 233/26 |
| 4,304,356 | 12/1981 | Chulay et al. | 233/26 |
| 4,306,676 | 12/1981 | Edwards et al. | 233/26 |
| 4,375,272 | 3/1983 | Sutton, III | 494/16 |
| 4,511,349 | 4/1985 | Nielsen et al. | 494/16 |
| 4,552,278 | 11/1985 | Romanauskas | 215/277 |
| 4,692,137 | 9/1987 | Anthony | 494/85 |
| 4,844,818 | 7/1989 | Smith | 494/16 |
| 5,158,749 | 10/1992 | Eberle | 422/102 |
| 5,288,466 | 2/1994 | Burns | 494/16 |

FOREIGN PATENT DOCUMENTS

| | | | |
|---|---|---|---|
| 1912322 | 3/1969 | Germany . | |
| 1966274 | 3/1969 | Germany . | |
| 1966805 | 3/1969 | Germany . | |
| 3343846 | 6/1985 | Germany | 494/16 |
| 3512848A1 | 4/1986 | Germany . | |
| WO 91/06373 | 11/1990 | WIPO . | |
| WO 9219382 | 5/1992 | WIPO | B04B 5/02 |

*Primary Examiner*—Terrence R. Till

*Attorney, Agent, or Firm*—Ohlandt, Greeley, Ruggiero & Perle

[57] ABSTRACT

An adapter for use in a fixed angle centrifuge rotor has, in use, a radially inboard and a radially inboard portion. An opening is formed in the radially inboard portion of the adapter. The opening is sized so that substantially no part of the inboard portion of the adapter is exposed during centrifugation to a load that exceeds the ability of the material of the adapter to support itself. The material of the inboard portion of the adapter surrounding the opening has sufficient strength to support itself while under centrifugation. The adapter is fabricated from a light transmissive material. A plug that is slidably disposed and selectably positionable within the opening in the inboard segment of the adapter. The inside surface of the plug having a sealing material thereon that is biased into contact with a tube carried within the adapter.

12 Claims, 6 Drawing Sheets

ADAPTER FOR CENTRIFUGE TUBE

BACKGROUND OF THE INVENTION

1. Field of the Invention

The present invention relates to a cartridge adapter for a centrifuge tube.

2. Description of the Prior Art

PCT publication WO 91/06373 discloses a cartridge adapter for supporting a sealed centrifuge tube within a cavity of a centrifuge rotor. The cartridge adapter comprises a pair of matable adapter segments, each of which has an indentation therein. When the segments are joined along mating surfaces the indentation in each segment cooperate to define a recess having a size and shape that closely corresponds (within a certain range of manufacturing tolerances) to the size and shape of some portion or all of the sealed centrifuge tube. When the cartridge adapter is introduced into a rotor cavity one of the two segments, termed the inboard segment $A_i$, lies radially closer to the axis of rotation VCL. The inboard segment $A_i$ has a keying feature thereon which identifies it as the segment that is introduced into the radially inboard side of the cavity C. The other segment, termed the radially outboard segment $A_o$, lies radially outwardly of the inboard segment and radially further from the axis of rotation VCL.

FIGS. 1A and 1B are top sectional views, taken in a plane transverse to the longitudinal axis of a prior art sealed plastic centrifuge tube T illustrating the inboard and outboard segments $A_i$, $A_o$, respectively, of a cartridge adapter as they support the tube T within a cavity C of a rotor V, illustrated as a vertical angle rotor. At rest, as shown in FIG. 1A, the inside surfaces of the respective inboard and outboard segments $A_i$ and $A_o$ of the adapter lie (within dimensional tolerances) close to or in physical contact with the exterior surface of the sealed tube about its entire circumference. It is noted that the inside surfaces of the adapter segments lie in this disposition with respect to the tube throughout the tube's entire axial length. That is, for each transverse section along the longitudinal axis of the tube, the relationship shown in FIG. 1A is maintained.

With reference to FIG. 1B, as the rotor is spun about the axis of rotation VCL the tube T is exposed both to a radially outwardly directed force $F_c$ and an internal hydrostatic pressure force $F_h$. The force $F_c$ is caused by the mass of the tube itself under centrifugal load. The force $F_h$ is caused by the mass of the liquid contents of the tube under centrifugal load. In a first portion $P_1$ of the tube, viz., a portion of the tube T received in the radially inboard segment $A_i$, the vector sum of the forces $F_c$ and $F_h$ is such that the tube deflects radially outwardly to form a depression indicated by the character D in FIG. 1B. The outer surface of this portion $P_1$ of the tube is spaced from, or defines a clearance with, the adjacent region R of the inner surface of the inboard segment $A_i$. This spacing is indicated by the character S in FIG. 1B, while the region R of the inboard segment $A_i$ is indicated by the dot-dash arc. The radial magnitude of the spacing S is dependent upon both the volume, the compressibility of the liquid within the sealed tube, and, in some instances, the fit of the tube T into the adapter.

Throughout the remaining portion of the circumference of the tube T the vector sum of the forces $F_c$ and $F_h$ is such that the exterior of the tube T is forced into intimate contacting relationship with the inner surface of the inboard and outboard segments $A_i$ and $A_o$ of the adapter lying adjacent thereto. The region of intimate contact is indicated by the relatively heavy line of con As may be appreciated the depression D formed as described has a length dimension measured along the longitudinal axis of the tube. The magnitude of this length dimension is also dependent upon both the volume and the compressibility of the liquid within the tube. If, for example, a tube were completely filled with an incompressible liquid, the force of the liquid would balance the centrifugal force and the depression would likely not form. Since, in practice, the tube is seldom totally filled and liquids are compressible to some extent, a depression D is likely to form along some portion of the length of the radially inward portion of the tube T. The depression may be envisioned as a dimple in the radially inward portion of the tube.

Since the material of the tube in the depression D is spaced from the inner surface of the region R of the inboard segment $A_i$ the hydrostatic force of the liquid within the tube T is not able to provide any support for this region of the inboard segment $A_i$. The hydrostatic force of the liquid within the tube T does, however, provide some support to that region of the inboard segment $A_i$ into which the tube T has been forced into intimate contacting relationship. As a result, in use, the unsupported region R of the inboard segment of the adapter is deflected radially outwardly.

The magnitude of the deflection is illustrated in FIG. 2 by surface contours of constant deflection or stress. Although FIG. 2 is a vertical perspective taken along a vertical central plane through one half of the inboard segment $A_i$ it should be understood that the surface contours shown in FIG. 2 are symmetric about the vertical central plane. The magnitude of the relative deflections of the region R of the inboard segment $A_i$ of the adapter are indicated by the characters $\delta_1$ through $\delta_4$. Since relatively greater deflections produce relatively greater stresses in the adapter segment the surface contours indicating the relative magnitude of the attendant stresses are similar in form to the surface contours of the deflection. The stress contours are thus shown in FIG. 2 and are indicated by the characters $\delta_1$ through $\delta_4$, respectively. The character $\delta_1$ and the character $\delta_1$ indicate the greatest magnitude of deflection or stress, as the case may be. Those areas of the inboard segment $A_i$ experiencing higher deflections and higher stresses are more likely to fail.

Accordingly, in view of the foregoing it is believed advantageous to provide an adapter in which the areas of relatively higher deflections and higher stresses are eliminated or substantially reduced.

It is common practice in molecular biology applications to utilize a technique termed "equilibrium centrifugation" to isolate various materials in a sample in accordance with their respective density. Typically ethidium bromide, a mutagen, is intercalculated in the material of interest. After centrifugation, with the tube at rest and upright, the materials reorient to form transverse bands at longitudinally spaced locations along the axis of the tube. The ethidium bromide when exposed to ultraviolet light absorbs the ultraviolet light and emits a visible fluorescent light which facilitates location of the band having the material of interest.

One prevalent method to withdraw a band having a material of interest is to hold the tube in a position so that ultraviolet light can shine therethrough to locate the band. The tube may be held by hand or clamped to a stand. A vent needle is inserted into the tube above that band (usually near to the top of the tube). The operator must steady the tube (whether or not it is clamped) while a syringe is then inserted into the tube. The syringe is inserted such that the tip thereof lies immediately beneath the band of material of interest enabling that band to be withdrawn. This process is repeated for each band having a material of interest.

This technique is perceived to exhibit a variety of drawbacks. The operator is exposed to the risk of puncture while handling the tube during the withdrawal process. Further, as should be readily apparent, once the syringe is removed from the tube, liquid from the tube leaks through the punctured opening therein the tube. Typical expedients for preventing such leaks include taping the tube wall or closing the puncture with the clinician's finger until such time as the tube may be deposited into a pool of inactivating liquid. Since ethidium bromide is a known mutagen physical contact with it should be minimized.

Accordingly, in view of the foregoing it is believed advantageous to provide an adapter that supports the tube during centrifugation and also facilitates removal of material without the perceived disadvantages of the prior art.

SUMMARY OF THE INVENTION

In a first aspect the present invention is directed to an adapter for use in a fixed angle centrifuge rotor, the adapter having, while being spun, a portion that lies radially inboard and an portion that lies outboard with respect to an axis of rotation. The adapter has a recess sized to receive a centrifuge tube. The tube is exposed, during centrifugation, to a load that causes a first portion of the tube to deflect radially outwardly from a first region of the inboard portion of the adapter while a second, adjacent, portion of the tube is forced into intimate contact with a second region of the inboard portion of the adapter. In accordance with the present invention the improvement in the adapter comprises an opening formed in the radially inboard portion of the adapter. Preferably, the opening is substantially coextensive with the first region of the inboard portion of the adapter. By appropriately sizing the opening substantially no part of the inboard portion of the adapter is exposed during centrifugation to a load that exceeds the ability of the material of the adapter to support itself. Stated alternatively, the material of the inboard portion of the adapter surrounding the opening has sufficient strength to support itself while under centrifugation.

This aspect of the invention may be used with any form of adapter, whether it is integral or segmented. In the event the adapter is formed from matable inboard and outboard segments $A_i$, $A_o$, respectively, the opening is provided in the inboard segment $A_i$.

In accordance with a second aspect of the invention the adapter includes a plug that is slidably disposed and selectably positionable within the opening in the inboard segment of the adapter. The plug has an inside and an outside surface thereon. The inside surface of the plug has a sealing material thereon. The sealing material is biased into contact with a tube carried within the adapter. In the preferred embodiment the opening is large enough to allow the sample to be exposed to an ultraviolet light source and to enable the band to be visually located. Alternatively or additionally, the adapter may be fabricated from a material transmissive to visible light, so that a band exposed to ultraviolet light through the opening may be visually located through the adapter.

BRIEF DESCRIPTION OF THE DRAWINGS

The invention will be more fully understood from the following detailed description, taken in connection with the accompanying drawings, in which.

DETAILED DESCRIPTION OF THE DRAWINGS

Figure 1A:
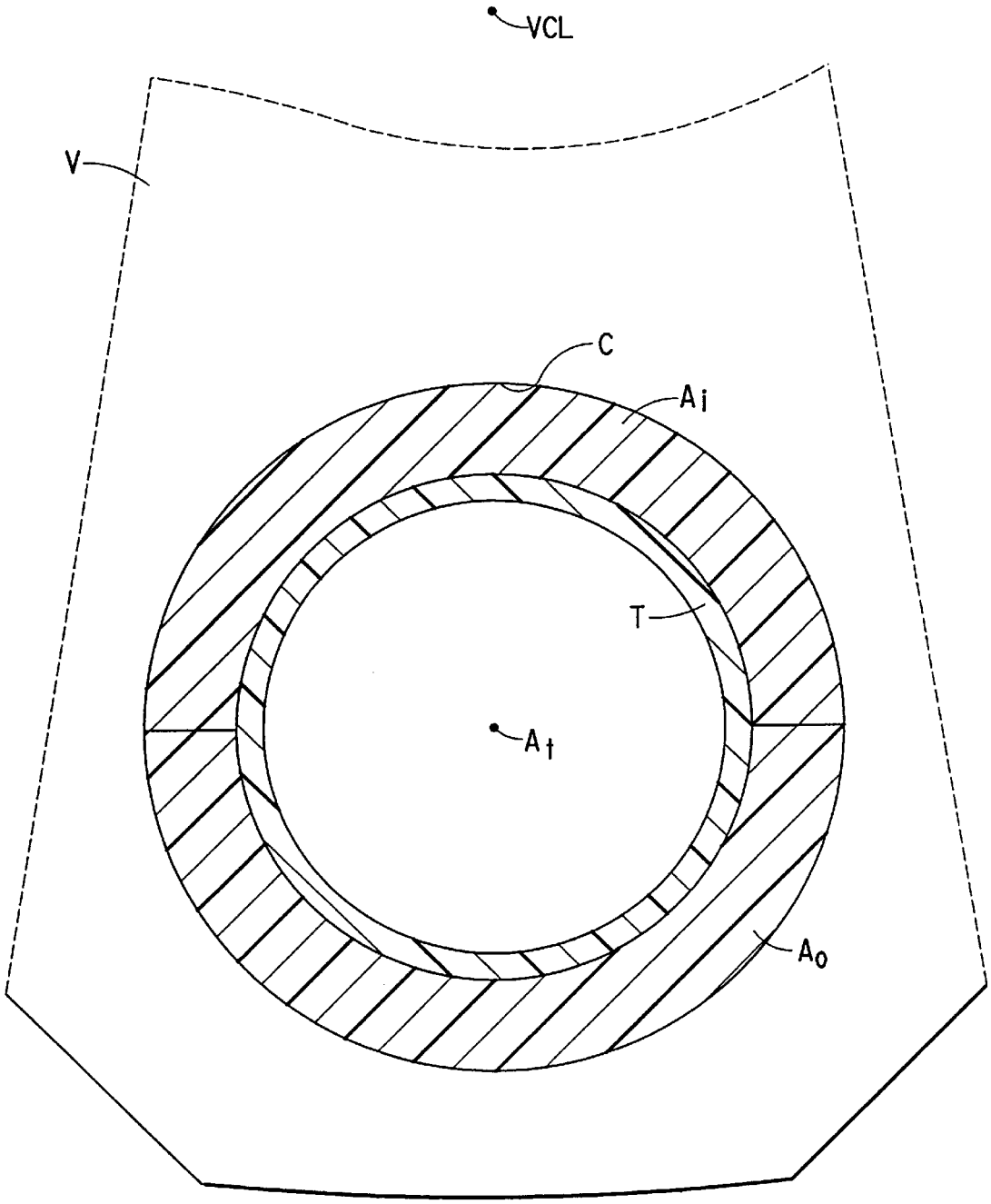
FIG. 1A (PRIOR ART)
FIGS. 1A and 1B are a top sectional views, taken in a plane transverse to the longitudinal axis of a sealed centrifuge tube, illustrating the inboard and outboard segments of an adapter of the prior art when supporting the sealed tube within a cavity C of a rotor R while at rest and while spinning, respectively.
Figure 1B:
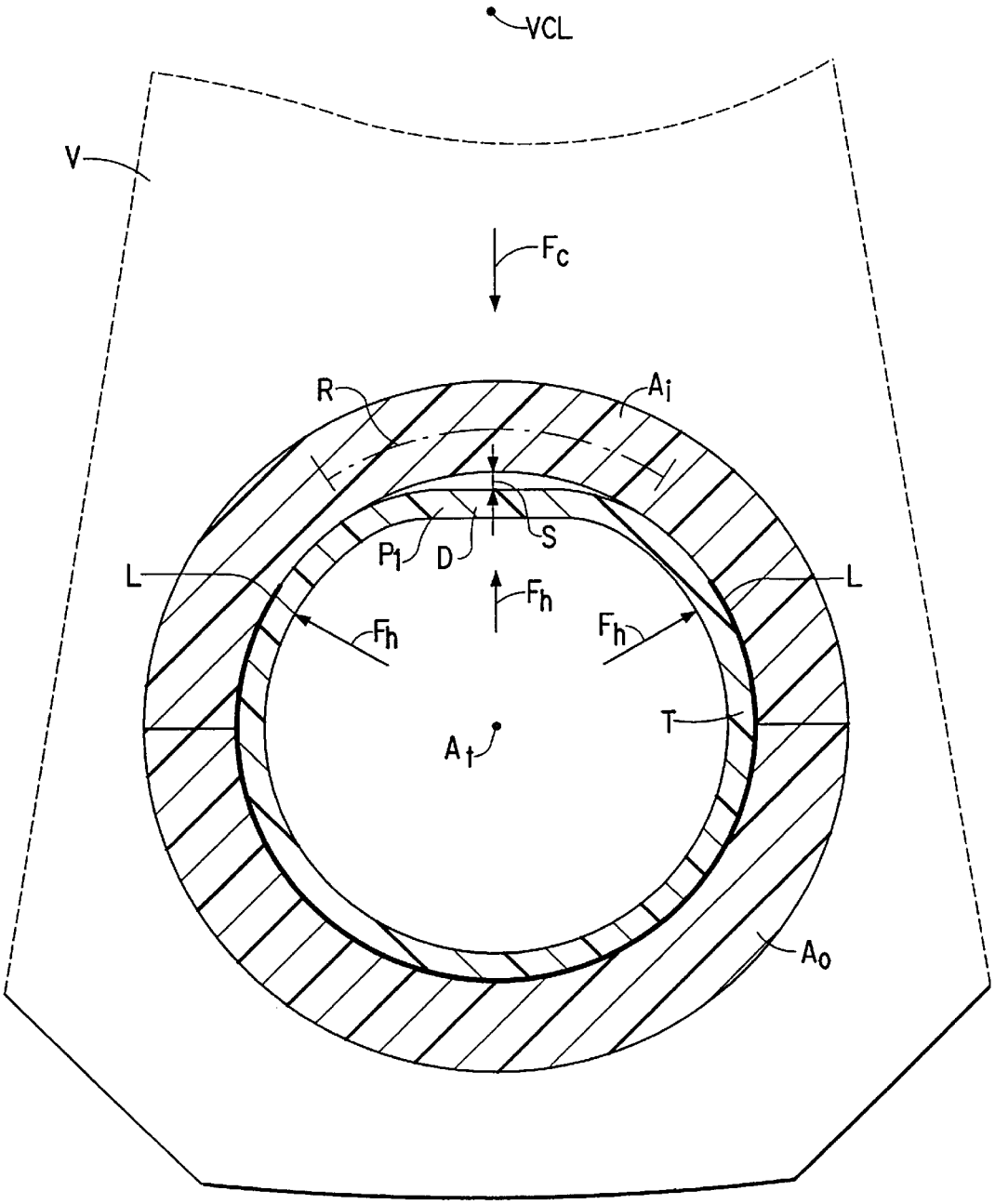
FIG. 1B (PRIOR ART)
Figure 2:
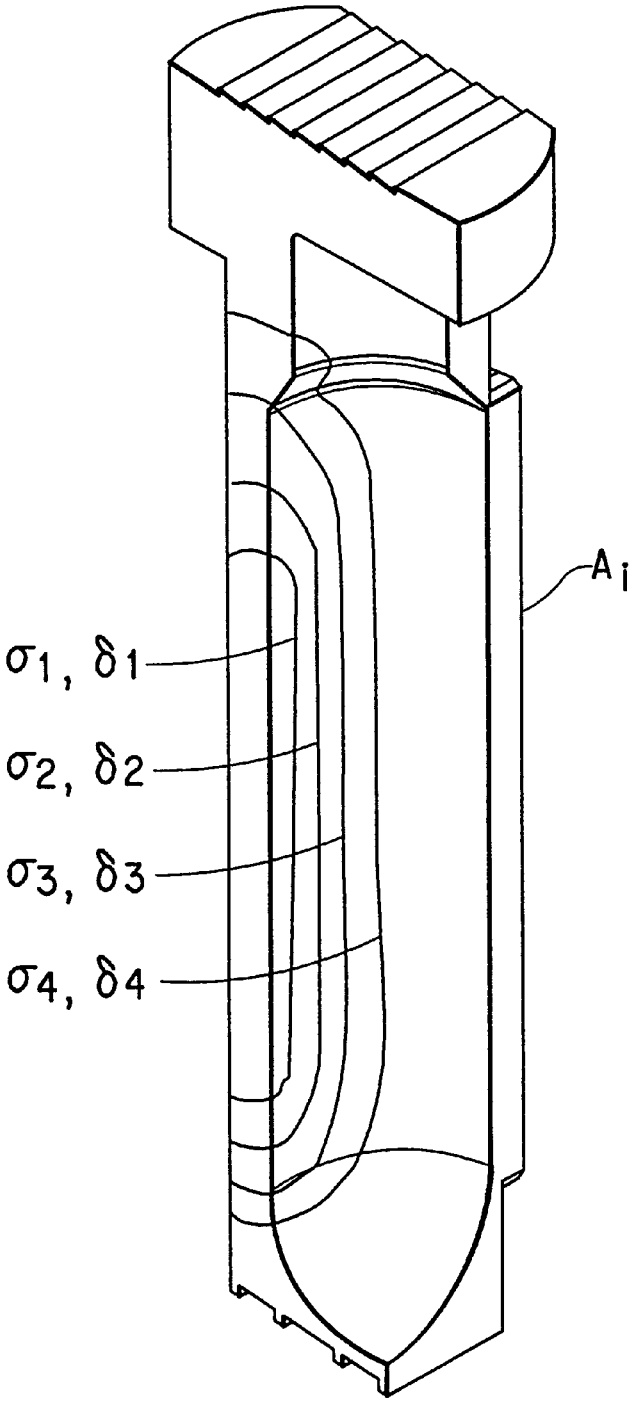
FIG.2 (PRIOR ART)
FIG. 2 is a vertical perspective taken along a vertical central plane through the inboard segment $A_i$ illustrating the surface contours of deflections and stress therein due to the formation of a depressed region in the tube while the tube is being spun, with the surface contours being symmetric about the central plane.

Throughout the following detailed description similar reference characters refer to similar elements in all Figures of the drawings.

Figure 3:
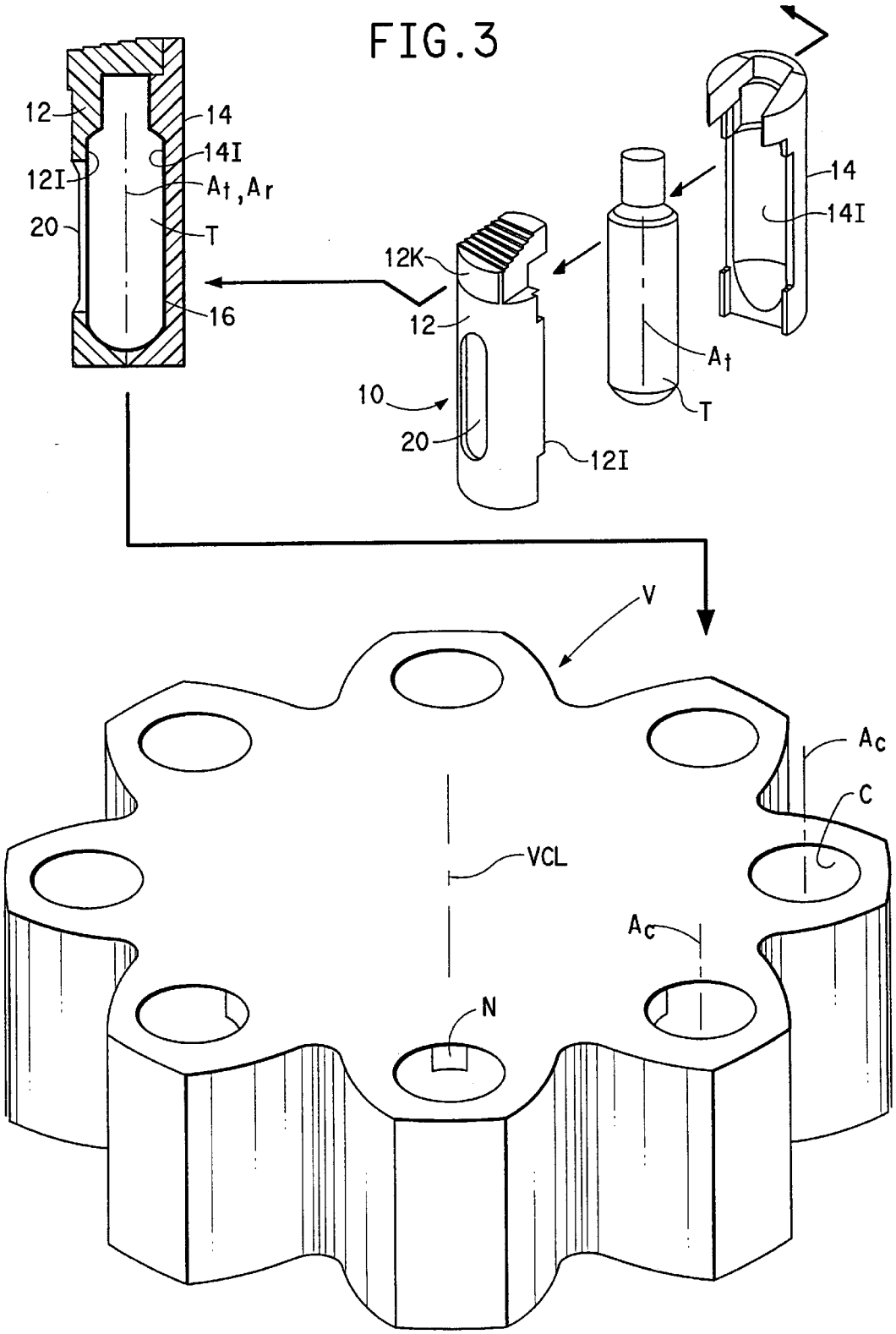
FIG. 3 is an exploded perspective view of an adapter for a centrifuge tube in accordance with a first aspect of the present invention, with the majority of the Figure being shown in perspective while a portion thereof is shown in vertical cross section.
Figure 4A:
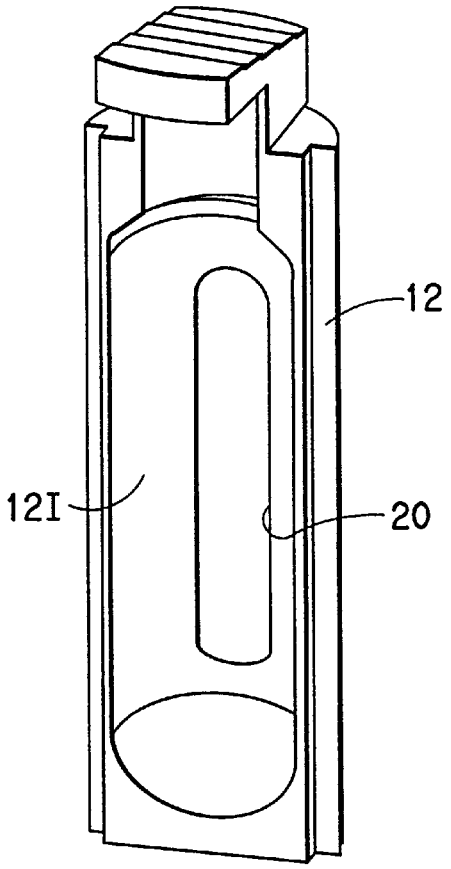
FIGS. 4A and 4B are, respectively, perspective views illustrating the interior and the exterior surfaces of the inboard segment of the adapter of FIG. 3, respectively.
Figure 4B:
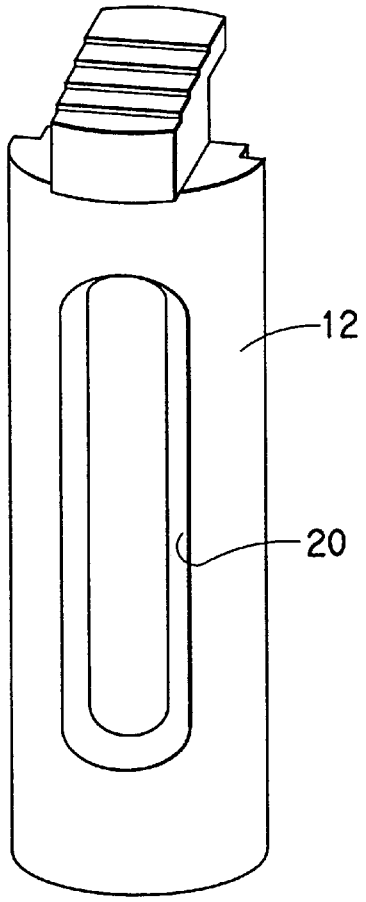

With reference to FIGS. 3, 4A and 4B, respectively shown are various perspective views of an adapter generally indicated by the reference character 10 in accordance with the present invention. The adapter 10 is used to adapt tubes T for centrifugation in a fixed angle centrifuge rotor V. The rotor V has cavities C therein. Each cavity may have a notch N therein.

In the illustrated embodiment the adapter 10 has an inboard segment 12 and an outboard segment 14. The inboard segment 12 may have a keying feature 12K thereon which is received in the notch N. Both segments 12 and 14 have an indentation 12I, 14I therein. When the adapter segments 12, 14 join the indentations 12I, 14I cooperate to form a recess 16 (FIG. 3) sized to receive the centrifuge tube T. The segments 12 and 14 of the adapter 10 are in the preferred case fabricated, as by injection molding, from a material such as thirty percent carbon fiber reinforced polyphthalamide such as that sold by RTP Company, Winona, Minn. under product number RTP 4085. In those instances when the material of the adapter is light transmissive (as discussed herein), the adapter 10 may be injection molded from a polycarbonate plastic material.

As used in this application the term "fixed angle centrifuge rotor" means a rotor of the type having cavities formed in the body thereof so that, when a tube is received therein the axis $A_t$ of each tube is inclined at a predetermined angular inclination with respect to the axis of rotation VCL and remains in that inclination throughout the centrifugation run. In this sense a "fixed angle centrifuge rotor" is to be distinguished from a so-called "swinging bucket centrifuge rotor" in which the inclination of the tube with respect to the axis of rotation is initially at approximately zero degrees and which, under centrifugation, swings to an orientation in which the axis of the tube is substantially perpendicular to the axis of rotation. The angular inclination of the axis $A_t$ of the tube may be produced by inclining the axis $A_c$ of the cavity C in the rotor with respect to the axis of rotation VCL, and/or by inclining the axis $A_r$ of the recess 16 in the adapter 10. Any angular value including zero degrees (a so-called "vertical rotor") may be used.

For the reasons discussed earlier, the tube is exposed, during centrifugation, to a load that causes a first portion of the tube to deflect radially outwardly from a first region of the inboard segment 12 of the adapter (corresponding to the region R as discussed above), while a second, adjacent, portion of the tube is forced into intimate contact with a second region of the inboard segment of the adapter. In an adapter in accordance with the present invention the inboard segment 12 has an opening 20 therein. The opening 20 is substantially coextensive with the first region first of the inboard segment 12. The opening 20 is sized so that substantially no portion of the inboard segment 12 of the adapter is exposed under centrifugation to a load that exceeds the ability of the material of the adapter to support itself. Stated alternatively, the opening 20 is sized so that the material of the inboard segment 12 of the adapter surrounding the opening 20 has sufficient strength to support itself while under centrifugation. The term "sufficient strength to support itself" means that the adapter 10 is not likely to fail when used at a predetermined maximum operating speed over a predetermined useful lifetime of cyclic operation. It should be understood that the term "substantially coextensive" as used throughout this application is meant to encompass an instance in which either more than or less than the entire first region of the inboard segment of the tube is removed. The intent is that by making the opening substantially coextensive with the first region of the inboard segment 12, the areas of relatively higher deflections and higher stresses are either eliminated or substantially reduced.

Although the invention has been heretofore described in the context of an adapter formed of matable segments as described in PCT publication WO 91/06373, the invention may be used with equal utility with an adapter that is integrally formed and which, in use, has a portion thereof that is radially inboard with respect to the axis of rotation and a portion that lies radially outboard with respect to the axis of rotation. The opening is provided in the radially inboard portion of such an integrally formed adapter. The opening is sized as discussed, so that the material of the inboard portion of the adapter surrounding the opening has sufficient strength to support itself while under centrifugation and so that no portion of the adapter is exposed under centrifugation to a load that exceeds the ability of the material of the adapter to support itself.

Figure 5A:
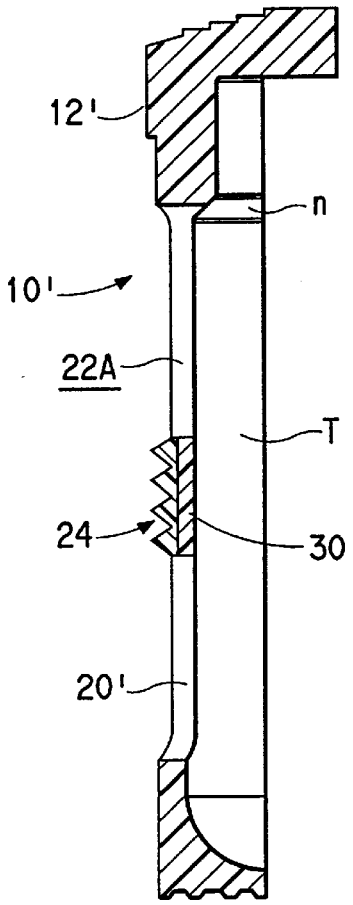
FIGS. 5A, 5B and 5C are, respectively, side sectional, front elevational (looking toward the inside surface) and top sectional views of an adapter in accordance with a second aspect of the present invention, with the tube being suggested in FIG. 5A.
Figure 5B:
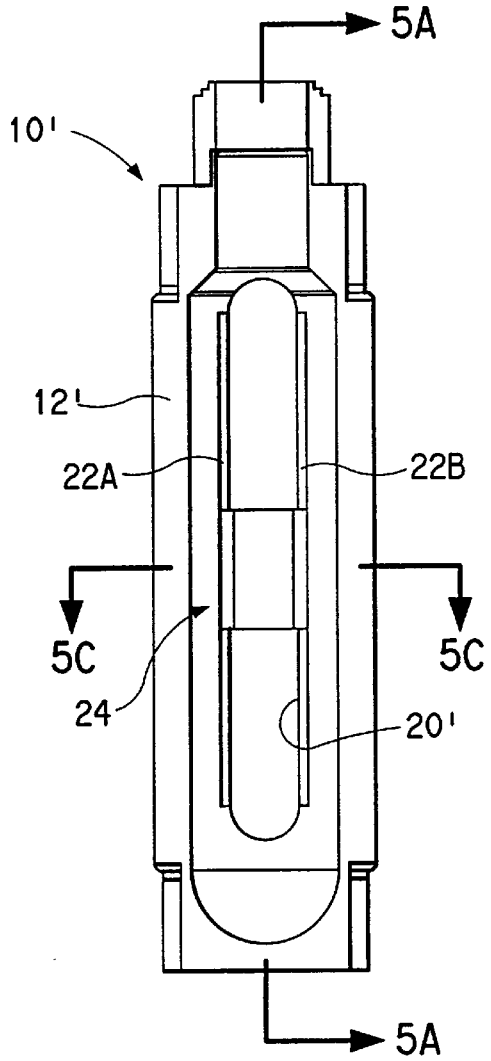
Figure 5C:
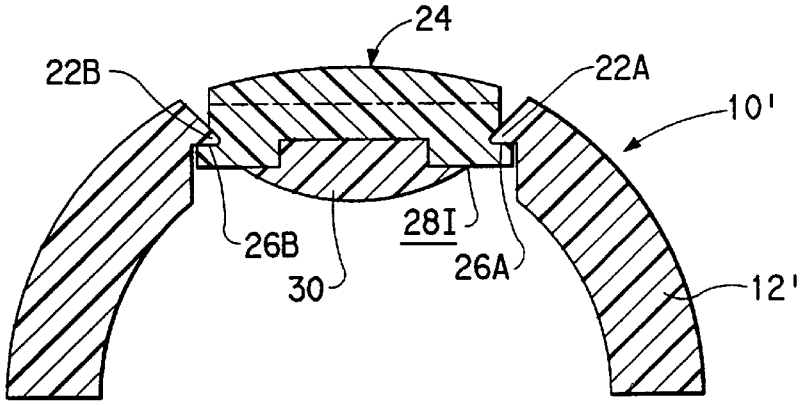

FIGS. 5A, 5B and 5C are, respectively, side sectional, front elevational and top sectional views of the inboard segment 12' of an adapter 10' in accordance with a second aspect of the present invention. The adapter 10' is especially configured to facilitate removal of bands of material formed during a equilibrium centrifugation separation. The adapter 10' may be segmented as shown in FIGS. 3 and 4 or integrally formed.

The radially inward segment 12' or the portion of the adapter 10' that lies radially inboard when in use has an opening 20' therein. The opening 20' is adapted to expose a portion of a tube T carried within the adapter. To permit withdrawal of a band of material of interest from the tube the opening 20' must be sized to allow the sample to be exposed to an ultraviolet light source and to enable the band to be visually located. Additionally, the position of the opening 20' should be such that the portion of the tube containing the band of material of interest and a region therabove (for venting purposes) is exposed and accessible. To permit withdrawal of any band of material of interest wherever it is located within the tube, the size and position of the opening 20' should be such as to expose and make accessible the maximum possible portion of the length of the tube (including the neck portion n thereof).

The size and position of the opening 20' should also be governed by the consideration of "sufficient strength to support itself" explained earlier. Since the sufficient strength consideration competes with the considerations of exposure and accessibilty discussed immediately above, in practice a suitable trade-off among operating speed, window size, and window position is required.

The adapter 10' has guide tracks 22A, 22B formed in the material of the adapter surrounding the opening 20'. A plug 24 has grooves 26A, 26B. The grooves 26A, 26B receive the guide tracks 22A, 22B whereby the plug 24 is slidably disposed along and selectably positionable within the opening 20'. The plug 24 has an inside surface 28I and an exterior surface 28E. The inside surface 28I of the plug 24 is presented toward the tube within the adapter 10'. The surface 28I has a layer of a sealing material 30, such as an elastomeric material, thereon.

The plug 24 is sized so that it may be carried on the adapter 10' during centrifugation and so that the sealing material 30 is biased into contact with the tube carried within the adapter. The tracks 22A, 22B are sized to provide support for the plug during centrifugation. No portion of the plug should extend outwardly beyond the outer diameter of the adapter 10 else a suitable opening must be provided in the rotor. Alternately, the plug 24 may be separate from the adapter 10' and inserted thereinto at the termination of a centrifugation run.

The exterior surface 28E has serrations 34 thereon to facilitate movement. If desired, additional plug(s) may be provided in the opening 20'.

The adapter 10' may be fabricated from a material (such as that earlier identified) that is transmissive to visible light. The material should be sufficiently translucent to permit visual location by an operator of a band of material of interest that has been exposed to ultraviolet light through the opening 20'. Most preferably, the material should be transparent. It is noted that the limitations imposed on the size of the opening 20' necessary to permit the band to be exposed to ultraviolet light may be disregarded if a material that is transmissive to both ultraviolet and visible light can be found to fabricate the adapter.

In use, after centrifugation, the adapter 10' with the tube therein is removed from the rotor. The adapter 10' may be held by hand or held by a clamp as the band of material of interest removed. Alternatively, and more preferably, the adapter 10' may be inserted into a suitable stand to provide access to the opening 20' and to hold securely the adapter in place. Thus, an operator would not be required to steady the adapter 20' during withdrawal of a band of material. The potential risk of puncture is thus avoided.

After removal of the syringe from the tube, a plug 24 is slid along the opening 20' until the sealing material 30 on the inside surface 28I thereof is positioned over the puncture in the tube. Since the sealing material 30 is biased into sealing engagement with the tube, liquid leakage through the puncture is effectively stopped. The magnitude of the biasing force need only be sufficient to prevent leakage while the tube is at rest. Additional withdrawal(s) of material may then be made.

Those skilled in the art, having the benefit of the teachings of the present invention as hereinbefore set forth, may effect numerous modifications thereto. Such modifications are to be construed as lying within the contemplation of the present invention, as defined by the appended claims.

What is claimed is:

1. In an adapter for use in a fixed angle centrifuge rotor, the adapter having an inboard and an outboard segment, the inboard segment having a first and a second region, the inboard segment and the outboard segment each having an indentation therein which cooperate to define a recess sized to receive a centrifuge tube, the tube being exposed, during centrifugation, to a load that causes a first portion of the tube to deflect radially outwardly from the first region of the inboard segment while a second, adjacent, portion of the tube is forced into intimate contact with the second region of the inboard segment, the improvement comprising:

the inboard segment of the adapter having an opening therein, the opening being substantially coextensive with the first region of the inboard segment of the adapter.

2. The adapter of claim 1 wherein the material of the inboard and outboard segments is a light transmissive material.

3. The adapter of claim 1 wherein the improvement further comprises:

a plug slidably disposed and selectably positionable within the opening in the inboard segment.

4. The adapter of claim 3 wherein the plug has an inside and an outside surface thereon, the inside surface of the plug having a sealing material thereon, the sealing material being biased into contact with a tube carried within the adapter.

5. In an adapter for use in a fixed angle centrifuge rotor, the adapter having an inboard and an outboard segment, the inboard segment and the outboard segment each having an indentation therein which cooperate to define a recess sized to receive a centrifuge tube, the improvement comprising:

the inboard segment of the adapter having an opening therein, the opening being sized so that the inboard segment of the adapter surrounding the opening has sufficient strength to support itself while under centrifugation.

6. The adapter of claim 5 wherein the material of the inboard and outboard segments is a light transmissive material.

7. The adapter of claim 5 wherein the improvement further comprises:

a plug slidably disposed and selectably positionable within the opening in the inboard segment.

8. The adapter of claim 7 wherein the plug has an inside and an outside surface thereon, the inside surface of the plug having a sealing material thereon, the sealing material being biased into contact with a tube carried within the adapter.

9. In an adapter for use in a fixed angle centrifuge rotor, the adapter having, while being spun, a portion that lies radially inboard and an portion that lies radially outboard with respect to an axis of rotation, the adapter having a recess sized to receive a centrifuge tube, the improvement comprising:

the inboard portion of the adapter having an opening therein, a plug slidably disposed and selectably positionable within the opening in the inboard segment, the plug having an inside and an outside surface thereon, the inside surface of the plug having a sealing material thereon, the plug being such that the sealing material is biased into contact with a tube received within the adapter.

10. The adapter of claim 9, wherein the adapter has an inboard and an outboard segment, the inboard segment of the adapter having the opening therein.

11. The adapter of claim 10, wherein the adapter is fabricated from a light transmissive material.

12. The adapter of claim 9, wherein the adapter is fabricated from a light transmissive material.

* * * * *